United States Patent [19]

Brill

[11] Patent Number: 4,557,078

[45] Date of Patent: Dec. 10, 1985

[54] METHOD OF DRESSING AND FINISHING GRINDING WHEELS

[75] Inventor: Jürgen Brill, Stuttgart, Fed. Rep. of Germany

[73] Assignee: Schaudt Maschinenbau GmbH, Stuttgart, Fed. Rep. of Germany

[21] Appl. No.: 603,459

[22] Filed: Apr. 24, 1984

[30] Foreign Application Priority Data

Apr. 27, 1983 [DE] Fed. Rep. of Germany ..... 3315196

[51] Int. Cl.[4] ..... B24B 53/04

[52] U.S. Cl. ..... 51/325; 125/11 CD; 51/165.87

[58] Field of Search ..... 125/11 R, 11 CD; 51/165.87, 165.88, 325

[56] References Cited

U.S. PATENT DOCUMENTS 4,073,281 2/1978 Aseada ..... 125/11 CD
4,151,684 5/1979 Wada ..... 125/11 CD
4,235,218 11/1980 Iida ..... 125/11 CD
4,259,940 4/1981 Asano ..... 125/11 CD
4,420,910 12/1983 Lorsson ..... 51/165.88

*Primary Examiner*—Harold D. Whitehead
*Attorney, Agent, or Firm*—Peter K. Kontler

[57] ABSTRACT

The grinding wheel is first dressed by a dressing tool and is thereupon sharpened or finished by particulate material which is introduced into a gap between its working surface and a pressure applying roll. The latter is thereupon ground by the grinding wheel. The controls of the grinding machine are used to feed the grinding wheel toward the dressing tool and the roll to different extents in order to compensate for the fact or possibility that the wear upon the roll during finishing is or can be more pronounced than the wear upon the dressing tool during dressing of the grinding wheel. This also ensures that the width of the gap can be maintained at a given value during each of several successive finishing operations.

4 Claims, 5 Drawing Figures

METHOD OF DRESSING AND FINISHING GRINDING WHEELS

BACKGROUND OF THE INVENTION

The present invention relates to a method of treating grinding wheels, and more particularly to improvements in a method of dressing and thereupon finishing (sharpening) the working surfaces of grinding wheels, especially grinding wheels which contain cubic boron nitride.

A grinding wheel which contains cubic boron nitride is normally treated first by a dressing tool and thereupon by a pressure applicator simultaneously with admission of hard pulverulent finishing or sharpening material into a gap which is established between the pressure applicator and the working surface of the grinding wheel. The pressure applicator can constitute a workpiece which has been ground in a grinding machine, a specially designed shoe which is capable of defining with the working surface of the grinding wheel a gap of requisite width, or a roll which is mounted in the frame of the grinding machine and can be moved to a requisite position with reference to the working surface of the grinding wheel upon completion of the dressing operation. The particulate material which is used in conjunction with the pressure applicator to finish the working surface of the grinding wheel can be admitted in a suitable carrier medium such as wax, lubricating grease, liquid coolant or even air. As a rule, the finishing operation is regulated in that the force with which the pressure applicator bears against the particles of finishing material in the aforementioned gap is varied in the course of the finishing or sharpening operation. Reference may be had to U.S. Pat. No. 3,314,410 granted Apr. 18, 1967 to Knauer et al. as well as to the article "High-speed dressing of BORAZON CBN wheels" by Philipp E. Bonnice in "Cutting Tool Engineering", January/February 1975. It is further known to select the width of the gap between the working surface of the grinding wheel and the adjacent surface of the pressure applicator in dependency on the diameters of particles which are used in the course of the finishing operation. Reference may be had to German Auslegeschrift No. 10 80 433 and to German Offenlegungsschrift No. 26 39 058.

In order to ensure the establishment of a gap of requisite width (namely a gap which ensures that the particles are properly urged against the working surface of the grinding wheel so as to complete the finishing operation with little loss in time and to simultaneously place such working surface in optimum condition for the ensuing treatment of workpieces) as a function of the dimensions of particles which are used to carry out the finishing operation, it was already proposed to grind the pressure applicator (e.g., a rotary disc-shaped member) upon completion of each finishing operation. The extent of grinding of the pressure applicator was selected with a view to correspond to more pronounced wear upon the dressing tool in order to compensate for a change in the width of the gap as a result of more pronounced wear upon the dressing tool (than upon the pressure applicator) and for the ensuing change in the positions of wheel-engaging surfaces of the dressing tool and pressure applicator relative to each other (reference may be had to the aforementioned German Offenlegungsschrift No. 26 39 058). Such proposal failed to gain acceptance in the relevant industries and was not developed further because its reliability and utility are predicated on the assumption that the wear upon the dressing tool in the course of a dressing operation is more pronounced than the wear upon the pressure applicator in the course of a finishing or sharpening operation. Such situation is highly unlikely to arise, or it arises only infrequently under exceptional circumstances, because the dressing tool normally carries diamonds so that the wear upon such tool is minimal or non-existent. At any rate, the wear upon a dressing tool whose wheel-contacting surface is studded with industrial diamonds is incomparably less pronounced than that upon a pressure applicator. In fact, in many or in most instances, the wear upon the dressing tool (in contrast to the wear upon the pressure applicator) is so minimal that it can be disregarded in its entirety.

OBJECTS AND SUMMARY OF THE INVENTION

An object of the invention is to provide a novel and improved method which renders it possible to carry out predictable treatment of grinding wheels at desired intervals.

Another object of the invention is to provide a method which renders it possible to select the width of the gap between the working surface of the grinding wheel and the adjacent surface of the pressure applicator with a much higher degree of predictability than in accordance with heretofore known methods.

A further object of the invention is to provide a method of the above outlined character which can be practiced with resort to available grinding machines and necessitates no alterations or slight modifications of such machines.

An additional object of the invention is to provide a method which renders it possible to establish between the grinding wheel and the pressure applicator a gap of optimum width, even if the wear upon the pressure applicator in the course of a finishing or sharpening operation is incomparably more pronounced than the wear upon the dressing tool in the course of a dressing operation.

A further object of the invention is to provide a method which can be practiced with equal advantage by resorting to any one of a wide variety of pressure applicators, not only as regards their composition but also as concerns their size and shape.

Still another object of the invention is to provide a grinding machine which can be used for the practice of the above outlined method.

Another object of the invention is to provide a method which ensures repeated treatment of a grinding wheel with a heretofore unmatched degree of accuracy, especially as concerns the finishing or sharpening operation.

An additional object of the invention is to provide a method which ensures rapid completion of treatment of a grinding wheel irrespective of whether it is the first or a next-following one of a series of timely spaced-apart treatments.

A feature of the invention resides in the provision of a method of repeatedly dressing and finishing (sharpening) a grinding wheel (especially a grinding wheel which contains cubic boron nitride) in a machine wherein the grinding wheel is dressed by a disc-shaped, plate-like or otherwise configurated dressing tool and is thereupon finished or sharpened as a result of introduction of hard particles into the gap between the working surface of the grinding wheel and a roll-shaped or otherwise configurated pressure applicator. The method comprises the steps of dressing the grinding wheel, finishing or sharpening the grinding wheel with attendant reduction of the dimensions of the pressure applicator, grinding the pressure applicator with resort to the grinding wheel, utilizing the thus dressed and finished grinding wheel for the treatment of workpieces with resulting growing need for renewed dressing and finishing, dressing the grinding wheel again, when necessary, thereupon finishing the dressed grinding wheel, and grinding the pressure applicator with resort to the grinding wheel including reducing the distance between the grinding wheel and the pressure applicator in comparison with such distance in the course of the preceding grinding of the pressure applicator by a value which is not less than (and can approximate or equal) the extent of wear upon the pressure applicator in the course of one of the finishing steps irrespective of eventually developing and possibly increasing differences in the position of the wheel-contacting surfaces or portions of the dressing tool and pressure applicator relative to each other. The tool and the applicator are, or can be, mounted on a common carriage which is preferably reciprocable in parallelism with the axis of the grinding wheel, and the carriage for the grinding wheel is preferably reciprocable at right angles to such axis.

The method preferably further comprises the step of selecting (during the next-following dressing and finishing of the grinding wheel) the mutual positions of the grinding wheel on the one hand and the dressing tool and pressure applicator on the other hand as a function of differences in the positions of the wheel-contacting surfaces of the dressing tool and pressure applicator relative to each other.

The novel features which are considered as characteristic of the invention are set forth in particular in the appended claims. The improved method itself, however, together with additional features and advantages thereof, will be best understood upon perusal of the following detailed description of certain specific embodiments with reference to the accompanying drawing.

DESCRIPTION OF THE PREFERRED EMBODIMENTS

Figure 1:
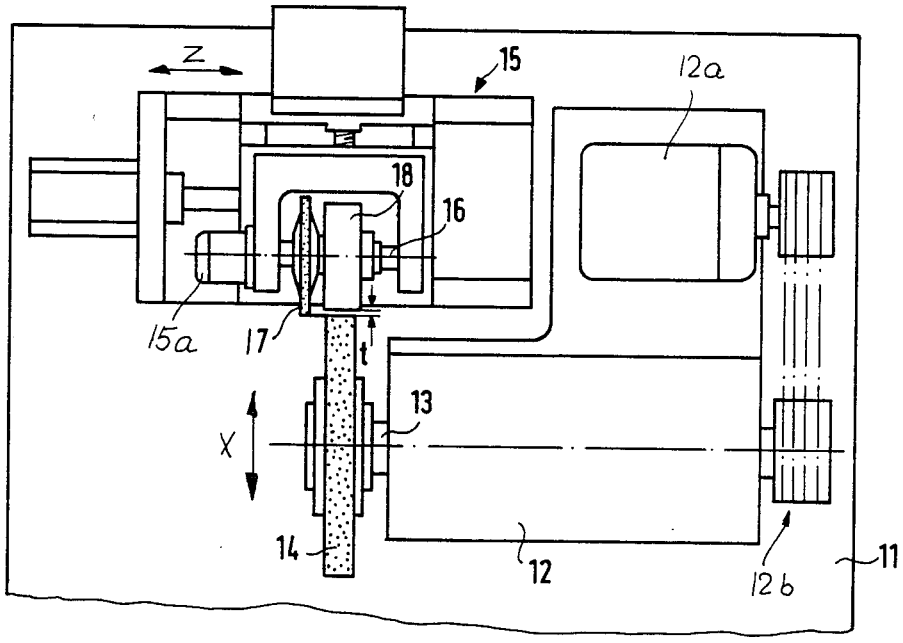
FIG. 1 is a fragmentary schematic plan view of a grinding machine which can be utilized for the practice of the improved method.

The grinding machine which is shown in FIG. 1 comprises a base or bed 11 supporting a mobile headstock or carriage 12 for the spindle 13 of a grinding wheel 14 which latter preferably contains cubic boron nitride. The bed 11 further supports a second mobile carriage 15 for a shaft 16 which is parallel to the spindle 13 and carries a rotary roller-or disc-shaped dressing tool 17 as well as a rotary roll-shaped pressure applicator 18. The carriage 12 is reciprocable in directions which are indicated by the double-headed arrow X, and the carriage 15 is reciprocable in directions which are indicated by the double-headed arrow Z. The carriage 12 further supports a motor **12*a* and a transmission 12*b* which latter receives torque from the motor 12*a* and transmits torque to the spindle 13. The shaft 16 can be driven by a motor 15*a* on the carriage 15. The means for reciprocating the carriages 12 and 15 are not specifically shown in FIG. 1**; they may comprise rack and pinion drives, feed screws or other suitable feeding means.

In the grinding machine of FIG. 1, the dressing tool 17 and the pressure applicator 18 are rotary members. However, it is equally possible to use a plate-like dressing tool and/or to employ a shoe in lieu of the rotary pressure applicator.

In the grinding machine of FIG. 1 and in the grinding machine of the aforementioned German Offenlegungsschrift No. 26 39 058, the radius of the pressure applicator is smaller than the radius of the dressing tool. The difference between the two radii is less than the maximum dimensions of discrete solid particles which are used in the course of the finishing or sharpening operation and are admitted into the gap t between the peripheral surface of the rotary pressure applicator and the working surface of the grinding wheel. The width of such gap is greatly exaggerated in FIG. 1 for the sake of clarity. Thus, the pressure applicator 18 of FIG. 1 is out of contact with the working surface of the grinding wheel 14, but such working surface would be contacted by the peripheral surface of the dressing tool 17 if the carriage 15 were shifted in a direction to the right, as viewed in FIG. 1. In actual practice, the width of the gap t is minute, e.g., in the range of fifty micrometers.

When the grinding wheel 14 of FIG. 1 requires treatment, it is dressed by the tool 17 in a first step, and such step is followed by the finishing or sharpening step which is carried out with solid particles fed into the gap t after the carriage 14 is returned to the position of FIG. 1. As a rule, the solid particles which are used to carry out the finishing operation are introduced in a suitable carrier medium, e.g., in an aqueous coolant. The carriage 12 can support a device which oscillates or vibrates the grinding wheel 14 in the course of the finishing operation. If the wear upon the dressing tool 17 in the course of a dressing operation is more pronounced than the wear upon the pressure applicator 18, the latter is ground by the grinding wheel 14 upon completion of the finishing or sharpening operation to an extent which is necessary to compensate for the difference between the reductions of radii of the parts 17 and 18. This means that, when the grinding of the pressure applicator 18 is completed, the difference between the radii of the parts 17 and 18 is again the same as that which has existed prior to the first stage (dressing) of the just completed treatment of the grinding wheel 14. Consequently, if the grinding wheel 14 is thereupon moved in one of the directions indicated by the arrow X so that its working surface contacts the wheel-contacting surface of the dressing tool 17, the width of the gap t between the working surface of the grinding wheel and the wheel-contacting surface of the pressure applicator 18 again equals the width of the gap t, i.e., the same as prior to the just completed dressing and finishing operations.

The aforedescribed mode of operation is feasible only when the wear upon the dressing tool 17 in fact exceeds the wear upon the pressure applicator 18, i.e., when the difference between the radii of such parts upon completion of a treatment would increase in favor of the radius of the pressure applicator. However, and as mentioned above, this is not the case in the majority of presently used grinding machines because the dressing tool is studded with diamonds and the wear upon such tool is negligible or nil. On the other hand, the wear upon a pressure applicator in the course of a finishing operation is noticeable so that the difference between the radii of the dressing tool and grinding wheel increases when the treatment of the grinding wheel is completed but in favor of the radius of the dressing tool. It will be readily appreciated that a grinding of the dressing tool 17 by the wheel 14 is not possible since this would amount to a renewed dressing of the grinding wheel but would not reduce the diameter of the dressing tool to any appreciable extent. In other words, when the wear upon the pressure applicator 18 is more pronounced than the wear upon the dressing tool 17 (a situation which arises in all or nearly all modern grinding machines), the difference between the radii of the parts 17, 18 will increase upon completion of each of a series of treatments of the grinding wheel. Consequently, the width of the gap t will increase and will rapidly assume a value which would stand in the way of any further finishing or sharpening of the grinding wheel because the particulate material would pass through the gap without even contacting the working surface of the grinding wheel.

In accordance with the method of the present invention, the just discussed conventional method of treating the grinding wheel is modified in such a way that the requirement for a predetermined relationship between the radii of the dressing tool and pressure applicator (if such parts are rotary members) is abandoned in its entirety. Instead, the improved method relies on the presence of positioning controls in modern grinding machines to select a gap t whose width is best suited for rapid and predictable finishing or sharpening of the grinding wheel upon completion of a dressing operation. This is achieved in that each finishing or sharpening operation is followed by a grinding of the pressure applicator to a preselected radius or diameter which is totally independent of the radius or diameter of the dressing tool. The new radius or diameter of the pressure applicator is memorized and is used as a reference value prior to the next finishing or sharpening operation in that the carriage 12 can be moved to a position at an optimum distance from the wheel-contacting surface of the pressure applicator prior to introduction of solid particles into the thus obtained gap t whose width is or can be the same as the width of the gap in the course of the preceding finishing operation.

Figure 2:
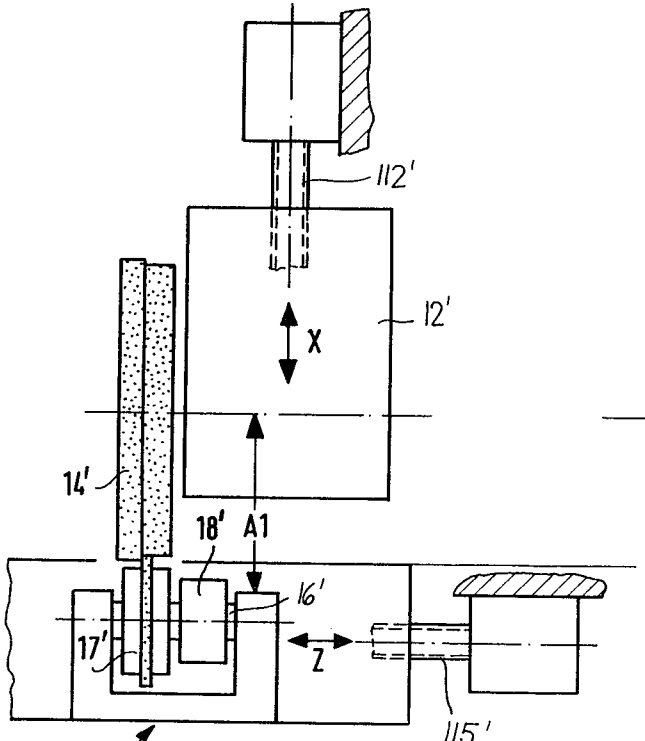
FIG. 2 shows on a larger scale certain details of the grinding machine in the course of a dressing operation.

FIG. 2 shows certain parts of a grinding machine in the course of a dressing operation. The carriage 12' has been moved by a feed screw 112' (in one of the directions indicated by the arrow X) to a position in which the axis of the grinding wheel 14' is located at a predetermined distance from the carriage 15' and the latter is then moved in one of the directions indicated by the arrow Z by a rotary feed screw 115' or the like so that the dressing tool 17' on the shaft 16' dresses the grinding wheel 14'. The extent of material removal at the working surface of the grinding wheel 12' by the dressing tool 17' has been exaggerated in FIG. 2 for the sake of clarity.

In accordance with the aforediscussed conventional method, completion of the dressing operation shown in FIG. 2 is immediately followed by the finishing or sharpening operation by moving the carriage 15' in order to place the pressure applicator 18' in front of the freshly dressed working surface of the grinding wheel 14' and by thereupon introducing particulate material into the gap between the grinding wheel 14' and the pressure applicator 18' while the grinding wheel rotates and while the pressure applicator rotates as a result of contact with particulate material and/or in response to transmission of torque from a suitable prime mover.

In accordance with the method of the present invention, the finishing or sharpening operation is preceded by the following steps: The carriage 15' is moved in the same way as in accordance with a conventional method so as to place the pressure applicator 18' into register with the grinding wheel 14'. However, the next step involves a movement of the grinding wheel 14' toward the carriage 15' so that the distance A1 (shown in FIG. 2) is reduced by the distance B (shown in FIG. 3) to A2. This compensates for the fact that the wear upon the pressure applicator 18' (in the course of the preceding finishing operation) was more pronounced than the wear upon the dressing tool 17' in the course of the preceding dressing operation. The grinding wheel 14' is thereupon finished as a result of introduction of particulate material into the gap between its working surface and the adjacent peripheral surface of the pressure applicator 18'. When the finishing operation is completed, the carriage 12' moves the grinding wheel 14' nearer to the carriage 15' through a distance which slightly exceeds the reduction of the radius of the applicator 18' in the course of the just completed finishing operation, and the wheel 14' thereupon grinds the applicator 18' so that the latter's diameter is reduced still further, i.e., such diameter is smaller (in comparison with the diameter of the dressing tool 17') than prior to the start of treatment of the grinding wheel 14'. Consequently, when the next dressing operation is completed, the distance B is increased in order to again establish between the grinding wheel 14' and the pressure applicator 18' a gap t whose width is the same as that of the gap which was established in the course of the preceding finishing operation.

The controls of the grinding machine memorize that position of the grinding wheel 14' which the latter assumes immediately following grinding of the pressure applicator 18'. The stored information is used in the course of the next treatment of the grinding wheel 14' to reduce the distance A2 of FIG. 3 accordingly, i.e., to again provide a gap t whose width is the same as that of the gap which was established during the preceding treatment of the grinding wheel 14'.

It will be noted that the difference between the radii of the dressing tool 17' and pressure applicator 18' increases after each and every treatment of the grinding wheel 14', not only to the extent which is the result of more pronounced wear upon the pressure applicator 18' (in the course of a finishing operation) than the wear upon the dressing tool 17' (in the course of a dressing operation) but also to the extent to which the diameter of the pressure applicator 18' is reduced as a result of grinding by the wheel 14' upon completion of the finishing operation. The radius of the freshly ground pressure applicator 18' is memorized and is then used for properly treating the grinding wheel 14' in the course of the next-following finishing or sharpening operation.

Figure 3:
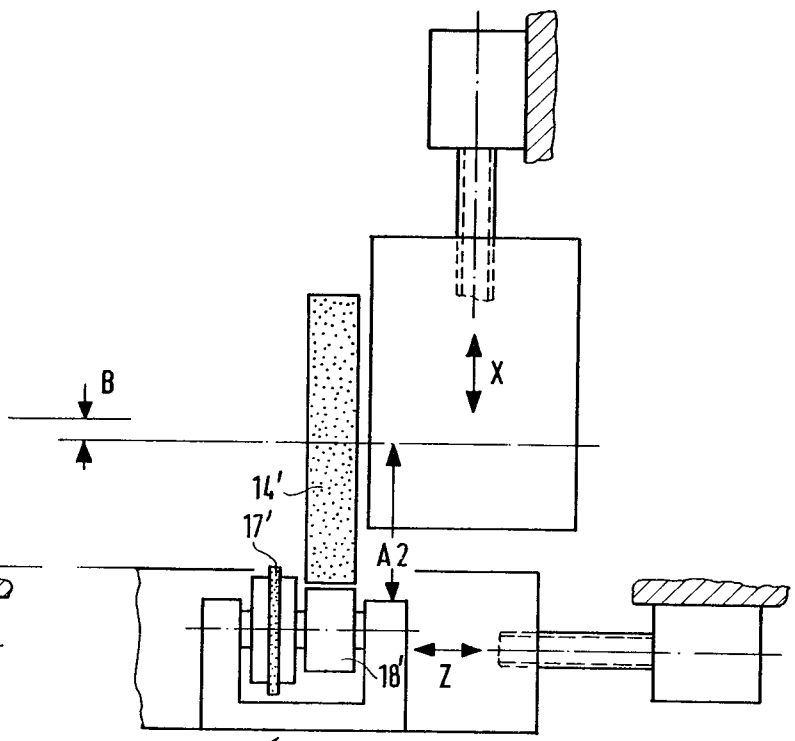
FIG. 3 shows on a larger scale certain details of the grinding machine in the course of a finishing operation.

The selection of various distances which were discussed in connection with FIGS. 1, 2 and 3 is based on the presently customary estimated or empirically ascertained wear upon the grinding wheel between successive treatments by a dressing tool and a pressure applicator in conjunction with particulate material, on estimated wear upon the dressing tool, on estimated thermal expansion of various parts of the grinding machine, and on the expected or desired extent of dressing of the grinding wheel. Such information is or can be stored in the controls of the grinding machine so as to allow for partly or fully automatic treatment of the workpiece in response to actuation of a suitable switch or the like which triggers a sequence of operations involving dressing and finishing of the grinding wheel. As a rule, and in order to be on the safe side, the estimated extent of material removal as a result of dressing is greater than necessary. Such mode of selecting the extent of material removal is adhered to in order to avoid insufficient treatment of the grinding wheel. This, of course, entails a premature consumption of the material of the grinding wheel and more pronounced wear upon the dressing and pressure applying instrumentalities. It will be readily appreciated that economy as well as other considerations speak in favor of an adjustment of various parts during treatment of a grinding wheel, which requires dressing and finishing, such that the extent of material removal from the grinding wheel is reproducible in the course of each of a short or long series of timely spaced treatments as well as that the dressing tool and/or the particulate material does not remove more material than absolutely necessary in order to restore the grinding wheel to proper operating condition. Such mode of treatment is desirable irrespective of whether the treatment is carried out in part under manual control or in a fully automatic way. One possibility of coming at least very close to such mode of treatment is to resort to suitable distance measuring means, e.g., a distance measuring instrument 119 including a mechanical sensor 19 which is shown in FIG. 4.

The instrument 119 is mounted on the carriage 15'' for the dressing tool 17'' and pressure applicator 18''. Its sensor 19 is shown in front of and in contact with the working surface of the grinding wheel 14'' whose carriage (not shown) is reciprocable in directions indicated by the arrow X. The carriage 15'' for the instrument 119, dressing tool 17'' and pressure applicator 18'' is reciprocable in directions which are indicated by the arrow Z. The instrument 119 transmits to the controls of the grinding machine a signal when the sensor 19 contacts the working surface of the grinding wheel 14'' and is disposed at the level of the wheel-contacting surface of the dressing tool 17'', i.e., the surface of the dressing tool 17'' would contact the working surface of the grinding wheel 14'' if the carriage 15'' for the parts 17'', 18'', 19, 119 were shifted in a direction to the left, as viewed in FIG. 4.

Figure 5:
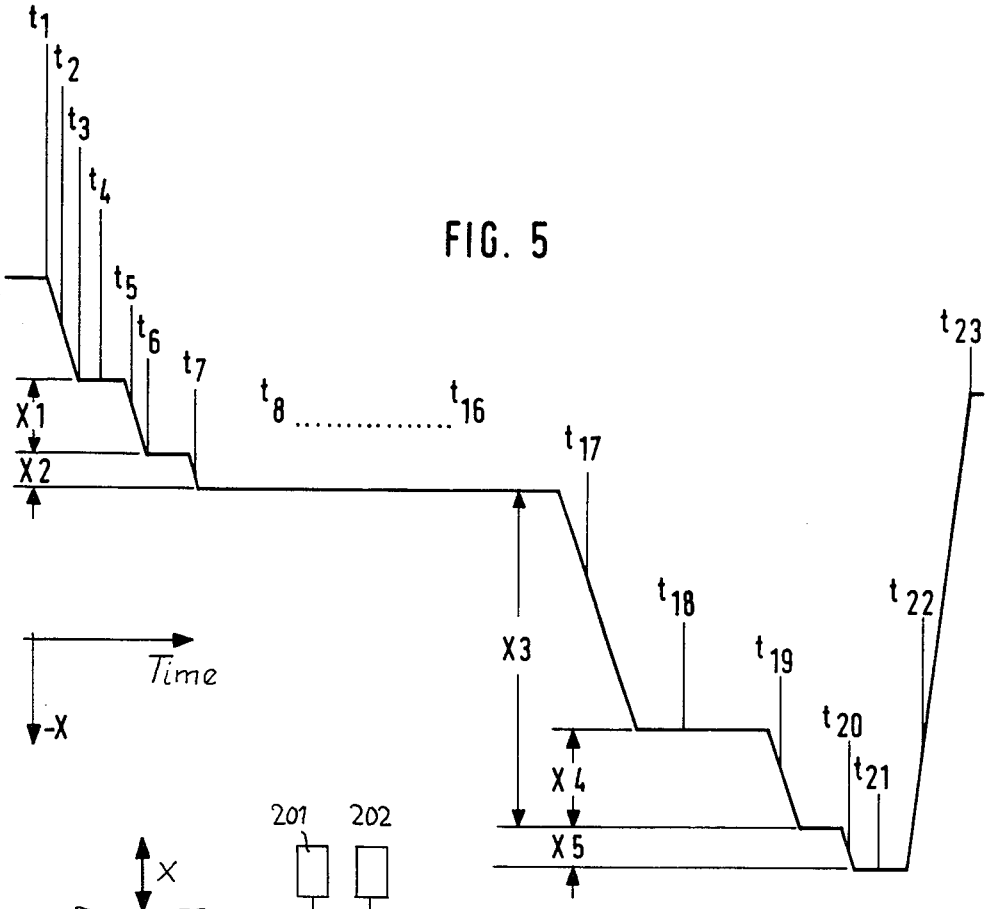
FIG. 5 is a motion diagram denoting various stages of the dressing, finishing and grinding operations in accordance with the improved method.

The mode of operation of the grinding machine which embodies the distance measuring instrument 119 of FIG. 4 will be described with continuous reference to the motion diagram of FIG. 5 wherein the movements of various parts in the directions indicated by the arrow X are measured along the ordinate and time is measured along the abscissa. A treatment of the grinding wheel 14'' begins at the instant $t_1$ and is terminated at the instant $t_{23}$. The mode of operation is similar to that which was described in connection with FIGS. 2 and 3 except that the provision of the distance measuring instrument 119 and its sensor 19 necessitates the addition of several steps which will be explained below.

Figure 4:
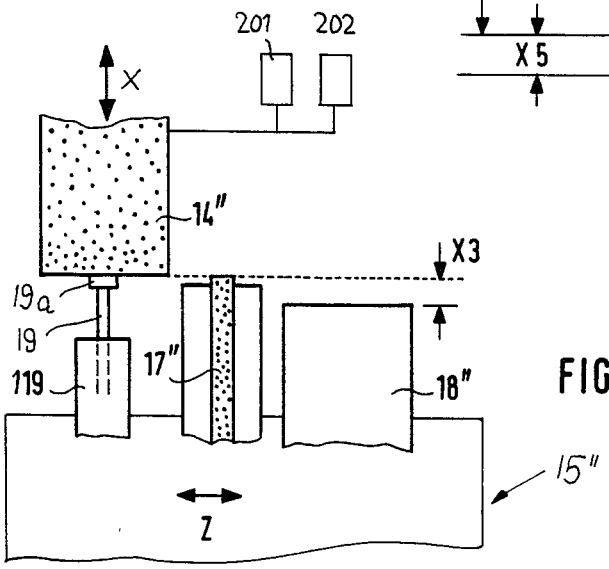
FIG. 4 is a fragmentary schematic plan view of a second grinding machine which is equipped with an instrument for monitoring the extent of movement of the grinding wheel in directions at right angles to its axis.

It is assumed that the controls of the grinding machine which employs the distance measuring instrument 119 of FIG. 4 contain several distance monitoring devices of conventional design which serve to record certain selected positions of mobile parts at selected times and which can be set to transmit at such times signals having preselected intensities (preferably zero) and/or other characteristics. Such monitoring devices are arranged to monitor movements in the directions which are indicated by the arrow X, i.e., at right angles to the axis of the grinding wheel 14''. A reduction of the radius of the grinding wheel 14'' as a result of wear can be taken into consideration by subtracting a corresponding value in the respective monitoring device. A specific example of such mode of operation will be explained below.

The just discussed distance monitoring devices constitute but one of various possible means for storing information pertaining to movements at right angles to the axis of the grinding wheel 14''. For example, it is also possible to resort to electronic memories which are used in many types of automatic machine tools and, therefore, their construction forms no part of the present invention.

It is further assumed that movements in the directions indicated by the arrow X are performed by the carriage for the grinding wheel 14'' and that movements in the directions indicated by the arrow Z are performed by the carriage 15'' for the instrument 119 and its sensor 19, dressing tool 17'' and pressure applicator 18''. However, it is equally within the purview of the invention to reverse the just mentioned mode of moving the mobile parts of the grinding machine by causing the carriage 15'' for the parts 119, 17'', 18'' to move at right angles to the axis of the grinding wheel 14'' and by causing the carriage for the grinding wheel to move in the direction of such axis. The first mode is preferred at this time because it is customary to move the workpiece (which is or can be mcunted on the carriage 15'' for the parts 119, 17'', 18'') in the directions indicated by the arrow Z and to move the carriage for the grinding wheel 14'' at right angles to the axis of the grinding wheel when the grinding machine is in actual use to treat a succession of workpieces by removing therefrom material by way of the grinding wheel.

At the start of a treatment of the grinding wheel 14'' (instant $t_1$), the sensor 19 of the instrument 119 is located in front of the grinding hweel 14'' (as shown in FIG. 4) but the front end face of the shoe **19*a* of the sensor is out of contact with the working surface of the grinding wheel. The sensor 19 has been moved to such position by the carriage 15''** which performs movements in the directions indicated by the arrow Z.

At the instant $t_2$, the grinding wheel 14'' is moved downwardly, as viewed in FIG. 4, and such feeding movement of the grinding wheel 14'' is terminated when a first monitoring device 201 transmits a zero signal. This means that, if the shoe **19*a* of the sensor 19 were depressed (at the instant $t_3$) it would have been moved to a position in which its front end face were located at the level of the wheel-contacting surface of the dressing tool 17''. The grinding wheel 14'' is then arrested, i.e., its movement toward the carriage 15'' is interrupted. At the same time, a second monitoring device 202** is blocked.

During the just discussed movement of the grinding wheel 14'', the shoe 19a of the sensor 19 was held in a fully or partly retracted position by an electromagnet (not shown) or another suitable retracting means of the instrument 119 so as to avoid damage to or unnecessary wear upon the shoe. The electromagnet is deenergized to release the sensor 19 so that the latter is acted upon by a spring (not shown) of the instrument 119 and the shoe 19a is moved into actual contact with the working surface of the grinding wheel 14'' at the instant $t_4$. The grinding wheel 14'' is thereupon advanced toward the second carriage 15'' (instant $t_5$). If the distance (X1) which has been covered by the grinding wheel 14'' on its way toward the carriage 15'' from the instant $t_3$ on (i.e., when the monitoring device 201 has assumed a zero position) and up to the instant $t_6$ corresponds to the extent of wear (reduction of radius) during the interval of time following the last treatment (dressing and finishing) of the grinding wheel, the instrument 119 transmits a zero signal to thus indicate that the working surface of the worn grinding wheel 14'' is disposed at the same level as the wheel-contacting surface of the dressing tool 17''. For the sake of clearer illustration, the diagram of FIG. 5 indicates that the forward movement of the grinding wheel 14'' toward the carriage 15'' is interrupted at the instant $t_6$ but this is not necessary in actual practice of the method. The grinding wheel 14'' then proceeds (or continues) to advance toward the carriage 15'' during the interval between the instants $t_6$ and $t_7$ to cover a predetermined distance X2. At such time, the electromagnet of the instrument 119 preferably holds the sensor 19 in retracted position to preserve the shoe 19a.

If the grinding machine operates without the instrument 119, its memory can store a signal denoting the distance X1 plus X2 which is then ascertained empirically.

At the instant $t_8$ (i.e., when the grinding wheel 14'' has completed its advance toward the carriage 15'' through the distance X2), the grinding machine proceeds to carry out the dressing operation by moving the carriage 15'' in a direction to the left, as viewed in FIG. 4, so that the tool 17'' dresses the grinding wheel 14''. At the instant $t_9$, the monitoring device 201 is set to zero (this position is the same as that which is reached at the instant $t_3$ during the next-following treatment of the grinding wheel). The blocking of the monitoring device 202 is terminated at the instant $t_{10}$. As a result of temporary blocking of the monitoring device 202, the latter has failed to record the distance X1 plus X2 (it was blocked at the instant $t_3$) which means that the zero point of the device 202 has been shifted accordingly, namely to account for a reduction of the radius of the grinding wheel during the interval following the last finishing operation (i.e., as a result of wear and also as a result of dressing).

The dressing operation is completed at the instant $t_{11}$ and the carriage 15'' is thereupon moved to place the sensor 19 back in front of the freshly dressed grinding wheel 14'' (instant $t_{12}$). The electromagnet holds the sensor 19 in retracted position during such movement of the carriage 15'' but is deenergized thereafter (instant $t_{13}$) so as to enable the sensor 19 to move its shoe 19a into contact with the working surface of the grinding wheel. At the instant $t_{14}$, the signal which is transmitted by the instrument 119 is set to zero by electronic means. This ensures that the measuring system is calibrated (set to zero) in the course of each and every treatment of the grinding wheel 14''. Such calibration ensures that the accuracy of the measurement signal at the instant $t_6$ is not adversely influenced by any, even minimal, wear upon the dressing tool 17'' and/or upon the shoe 19a of the sensor 19. Otherwise stated, the calibration ensures that the front end face of the shoe 19a is invariably located at the level of the wheel-contacting surface of the dressing tool 17'' at the required instant in the course of a treatment of the grinding wheel.

At the instant $t_{15}$, the sensor 19 is retracted from the grinding wheel 14'' and the carriage 15'' is shifted so as to place (at the instant $t_{16}$) the pressure applicator 18'' in front of the working surface of the grinding wheel.

The grinding wheel 14'' is moved toward the second carriage at the instant $t_{17}$ through the distance X3 until it assumes a position at a predetermined distance X4 from the position in which the pressure applicator 18'' was ground upon completion of the preceding treatment of the grinding wheel. The distance X4 matches the width of the gap which is established in accordance with the conventional method. In accordance with the novel method, the distance X4 is not dependent upon the ratio of the radius of the pressure applicator 18'' to the radius of the dressing tool 17''.

At the instant $t_{18}$, the grinding machine starts with the finishing or sharpening operation in that particulate material is introduced into the gap between the grinding wheel 14'' and the pressure applicator 18'' from a suitable container which is not shown in FIG. 4. The finishing operation is terminated at the instant $t_{19}$ and the grinding wheel 14'' is thereupon advanced toward the carriage 15'' until the monitoring device 202 transmits a zero signal. This position of the grinding wheel 14'' corresponds to that upon termination of the finishing operation during the preceding treatment of the grinding wheel, namely to the position of the grinding wheel in which the pressure applicator 18'' was ground during the preceding treatment. The wear upon the grinding wheel 14'' between the two grinding operations, the wear upon the pressure applicator 18'' as well as the extent of removal of material from the grinding wheel in the course of the preceding dressing operation were accounted for by blocking of the corresponding monitoring device 202 between the instants $t_3$ and $t_{10}$ so that (in such position of the grinding wheel 14'') the width of the gap between the pressure applicator 18'' and grinding wheel 14'' then corresponds to the extent of wear upon the pressure applicator in the course of the immediately preceding finishing operation. At the instant $t_{20}$, the grinding wheel 14'' is advanced through a predetermined distance X5 which is required to ensure adequate grinding of the pressure applicator 18''. The grinding of the pressure applicator 18'' is completed at the instant $t_{21}$ at which time the monitoring device 202 is reset to zero so that the grinding wheel will assume proper positions at the instants $t_{17}$ and $t_{19}$ during the next-following treatment, i.e., such positions will be selected by full consideration of wear which has taken place in the meantime.

The grinding wheel 14'' is returned to its working position (for removal of material from workpieces on the carriage 15'' or a different carriage) at the instant $t_{22}$ and the cycle is completed at the instant $t_{23}$.

The preceding description was made with reference to a grinding wheel having a simple working surface of at least substantially constant diameter. However, the improved method can be practiced with equal or similar advantage in connection with the treatment of grinding wheels with more or much more complex profiles, i.e., with recesses, undercuts and/or the like. The relatively simple dressing tools and pressure applicators are then replaced with more complex tools whose wheel-contacting surfaces are profiled accordingly and the grinding wheel and/or the carriage 15″ is then fed in the direction at right angles to the axis of the grinding wheel in the course of each dressing and finishing operation. Such modifications are well known to those who are familiar with the art of dressing and similarly treating grinding wheels.

The method which has been described with reference to FIGS. 4 and 5 ensures that certain parameters, such as the thermal expansion of certain parts of the grinding machine, the wear upon the grinding wheel during grinding of workpieces, the wear upon the dressing tool and/or the wear upon the sensor 19, can be fully and accurately compensated for by repeatedly moving the grinding wheel into contact with the shoe 19*a* and/or vice versa so as to memorize certain positions of the grinding wheel with reference to the instrument 119, dressing tool 17″ and/or pressure applicator 18″. Such mode of operation ensures utmost accuracy during each and every treatment of the grinding wheel 14″. If the requirements as to accuracy of finish of the grinding wheel are less stringent, the distance measuring instrument 119 is omitted or is rendered inactive. The values or distances denoted by signals which are generated by the instrument 119 are then empirically determined or estimated values which are stored in the memory of the grinding machine in a conventional way.

It will be noted that, in contrast to heretofore known conventional treatments of grinding wheels, the improved method does not require and does not even render desirable or advantageous the establishment and maintenance of a constant or unvarying difference X3 between the radius of the dressing tool and the radius of the pressure applicator. On the contrary, the difference X3 is increased by the value X5 upon completion of each treatment of the grinding wheel. Such increase of the difference X3 is compensated for by corresponding shifting of zero setting of the corresponding distance monitoring device 202 so that the absolute value of the difference X3 and the extent (X5) to which such difference increases from treatment to treatment can be selected at will (within practical limits). All that counts is that the improved method ensures the establishment of a gap of highly satisfactory width preparatory to each finishing or sharpening operation in spite of the fact that the ratio of radii of the dressing tool and pressure applicator need not be constant. This is accomplished by relying on those controls which are available in all or nearly all modern grinding machines so that the complexity of the grinding machine need not be increased for the purpose of practicing the improved method. As mentioned above, the dressing tool and/or the pressure applicator can be moved at right angles to the axis of the grinding wheel in lieu of such movement of the carriage for the grinding wheel, and the rotary dressing tool can be replaced with a plate. This also applies for the rotary pressure applicator.

A suitable control device for controlling the movements of the carriage is the NC-Control system "Sinumerik 3G" manufactured by Siemens AG, Munich, Western Germany. For Instrument 119 and monitoring devices 201 and 202 are used "WEMAR-Meβ-taster" indluding amplifier and "Autozero"-device, produced by MARPOSS Gesellschaft für Meβ-steuerungen m.b.H., 7012 Fellbach-Schmiden, Western Germany.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of repeatedly dressing and finishing a grinding wheel in a machine wherein the grinding wheel is dressed by a rotary dressing tool and is thereupon finished as a result of introduction of particulate material into a gap of predetermined width which is established between the working surface of the grinding wheel and a rotary pressure applicator which is coaxial with the grinding wheel, comprising the steps of dressing the grinding wheel; finishing the grinding wheel with attendant reduction of the dimensions of the pressure applicator; grinding the pressure applicator; memorizing information pertaining to the radius of the ground pressure applicator; utilizing the dressed and finished grinding wheel for the treatment of workpieces with the resulting need for renewed dressing and finishing; dressing and finishing the grinding wheel including selecting the distance between the axis of the grinding wheel and the common axis of the dressing tool and pressure applicator as a function of the memorized information; and grinding the pressure applicator including reducing the distance between the grinding wheel and the pressure applicator in comparison with such distance in the course of the preceding grinding of the pressure applicator by a value not less than the extent of wear upon the pressure applicator in the course of one of said finishing steps irrespective of the developing increasing difference between the positions of the wheel-contacting surfaces of the dressing tool and pressure applicator relative to each other.

2. The method of claim 1, wherein the grinding wheel contains cubic boron nitride.

3. The method of claim 1, wherein said value at least approximates the extent of wear upon the pressure applicator in the course of one of said finishing steps.

4. The method of claim 1, further comprising the step of selecting, during the next-following dressing and finishing of the grinding wheel, the mutual positions of the axis of the grinding wheel on the one hand and the common axis of the dressing tool and the pressure applicator on the other hand as a function of difference between the positions of said wheel-contacting surfaces relative to each other.

* * * * *